US006059307A

United States Patent [19]

Western

[11] Patent Number: 6,059,307

[45] Date of Patent: May 9, 2000

[54] SKATEBOARD DECK AND METHOD FOR MAKING THE SAME

[76] Inventor: Michael W. Western, P.O. Box 50367, Bellevue, Wash. 98015

[21] Appl. No.: 08/959,431

[22] Filed: Oct. 28, 1997

[51] Int. Cl.[7] ..... A63C 5/04

[52] U.S. Cl. ..... 280/609; 280/87.042; 428/50

[58] Field of Search ..... 280/87.042, 609, 280/610, 602; 428/63, 50

[56] References Cited

U.S. PATENT DOCUMENTS

| | | | |
|---|---|---|---|
| 3,173,161 | 3/1965 | Amsbry | 280/609 |
| 3,707,296 | 12/1972 | Palazzolo et al. | 280/610 |
| 4,140,326 | 2/1979 | Huber | 280/87.042 |
| 4,295,656 | 10/1981 | Moore | 280/87.042 |
| 4,697,821 | 10/1987 | Hayashi et al. | 280/609 |
| 4,974,868 | 12/1990 | Morris | 280/609 |
| 5,005,853 | 4/1991 | Lampl | 280/610 |
| 5,080,382 | 1/1992 | Franz | 280/87.042 |
| 5,238,260 | 8/1993 | Scherubl | 280/610 |
| 5,320,378 | 6/1994 | Wiig | 280/610 |

*Primary Examiner*—J. J. Swann
*Assistant Examiner*—David R. Dunn
*Attorney, Agent, or Firm*—Robert M. Storwick

[57] ABSTRACT

A skateboard deck and method for making the same. The skateboard deck is made from a wooden core. The core is made from a plurality of longitudinal portions that are each glued to one or two other horizontally adjacent longitudinal portions, so that they share a vertical planar joint. At least one end portion of the core has a transverse semicircular groove formed in its upper surface. The groove is filled by a cut-off semicircular cylindrical filler piece that has a smaller radius of curvature than the groove. The end portion of the core is bent upward and the filler piece is held in place by an epoxy resin. The entire core is then enclosed in a pregnable fabric impregnated with an epoxy resin and the enclosed core is held in place under pressure and elevated temperature until the epoxy resin has hardened. If desired, a steel protective piece can be placed against at least one end of the lower surface of the core before it is enclosed in the pregnable fabric. A key-shaped cutout in the steel protective piece locks the piece in position against the core.

7 Claims, 2 Drawing Sheets

SKATEBOARD DECK AND METHOD FOR MAKING THE SAME

TECHNICAL FIELD

The present invention relates to recreational equipment, and more particularly, to skateboard decks and methods and apparatus for making skateboard decks.

BACKGROUND OF THE INVENTION

Since their inception, skateboards have maintained a wide popularity as a form of recreation and competition throughout the world. Skateboards typically consist of a deck (where the skateboarder stands) and sets of wheels which support the deck from the surface supporting the wheels.

An important consideration throughout this period has been the development of stronger and lighter skateboard decks while containing their cost. Among other advantages, stronger and lighter decks allow skateboarders to perform more aggressive and intricate maneuvers without damaging the decks.

It has long been known to construct skateboard decks using cores that are covered with fiberglass cloth (or other similar mats or fabrics) that is impregnated with resin, which then hardened. However, it is continually desirable to both improve the strength and reduce the weight of skateboard decks.

Skateboard decks are subject to substantial impact and abrasion, particularly the under portion of the rear, or kick tail, of the skateboard deck. Accordingly, it is desirable to increase the abrasion resistance of skateboard decks.

SUMMARY OF THE INVENTION

According to one aspect, the invention is a method for making a skateboard deck. The method includes the step of a) providing a substantially planar piece of a first material having a longitudinal axis and two opposed surfaces separated by a substantially uniform thickness. The piece has a first end portion and a second end portion located opposite one another along the axis. The method further includes the step of b) forming a first substantially concave groove in one of the surfaces at the first end portion. The groove is substantially transverse to the axis and has a predetermined curvature at its deepest point. Further, the method includes the step of c) providing a first frustocylindrical plug of a second material having a substantially planar surface and a substantially convex surface. The plug has a curvature that is greater than the magnitude of the predetermined curvature of the groove.

In addition, the method includes the steps of d) coating at least one of the concave groove and the convex surface with a resin and e) placing the convex surface of the plug in the groove so "that the curvature of the plug is greater than the magnitude of the curvature of the plug" at the point where the plug meets the deepest point of the groove. Still further, the method includes the steps of f) bending the first end portion toward the one surface, and g) curing the resin. According the method, then, the first end portion is permanently bent upwardly toward the one surface.

According to a second aspect, the invention is a method for making a skateboard deck. The method includes the step of a) providing a substantially planar piece of a first material having a longitudinal axis and two opposed surfaces separated by a substantially uniform thickness. The piece has a first end portion and a second end portion located opposite one another along the axis. The method further includes the step of b) forming a thin protective piece from a piece of a second material. The protective piece is curved to substantially match the curvature of the first end portion of the piece of the first material. Still further, the method includes the step of c) coating the one side of the planar piece of the first material, the plug, and the protective piece of the second material with a coat of resin, the planar piece of the first material being coated near the first end portion. Further the method includes the step of d) curing the outer coat of resin.

According to a still further aspect, the invention is a method for making a skateboard deck. The method includes the step of a) providing a substantially planar piece of a first material having a longitudinal axis and two opposed surfaces separated by a substantially uniform thickness. The piece has a first end portion and a second end portion located opposite one another along the axis. This step includes a1) forming a plurality of longitudinal pieces of the first material, each of the longitudinal pieces having a longitudinal axis and a rectangular cross-section transverse to its longitudinal axis. Each of the rectangular cross-section longitudinal pieces having two opposed surfaces having a predetermined height. This step further includes a2) applying an adhesive to at least some of the opposed surfaces of the rectangular cross-section longitudinal pieces, and a3) assembling the rectangular cross-section longitudinal pieces so that at least one opposed surface of each of the rectangular cross-section longitudinal pieces is adjacent at least one opposed surface of another of the rectangular cross-section longitudinal pieces. Still further, this step includes a4) curing the adhesive so that the plurality of longitudinal pieces of the first material forms the substantially planar piece of the first material.

The method further includes the steps of b) applying resin to the substantially planar piece of the first material, and c) curing the resin.

According to a still further aspect, the invention is a skateboard deck. The skateboard deck includes a first piece of a first material having a longitudinal axis and two opposed surfaces separated by a substantially uniform thickness. The piece has a first end portion and a second end portion located opposite one another along the axis. The piece further has a first substantially concave groove formed in one of the surfaces at the first end portion, the groove being substantially transverse to the axis and having a predetermined curvature at its deepest point. The skateboard deck further includes a first frustocylindrical plug of a second material having a substantially planar surface and a substantially convex surface. The plug has a curvature that is greater than the magnitude of the predetermined curvature of the groove. The convex surface of the plug is placed in the groove so that the curvature of the plug is greater than the magnitude of the curvature of the plug at the point where the plug meets the deepest point of the groove. The first end portion is bent toward the one surface, so that the first end portion is permanently bent upwardly toward the one surface.

According to an even further aspect, the invention is a skateboard deck. The skateboard deck includes a substantially planar piece of a first material having a longitudinal axis and two opposed surfaces separated by a substantially uniform thickness, the piece having a first end portion and a second end portion located opposite one another along the axis. The skateboard deck further includes a thin protective piece formed from a piece of a second material. The protective piece is curved to substantially match the curvature of the first end portion of the piece of the first material. The protective piece of the second material is adhered to the substantially planar piece of the first material near the first end portion.

According to an even further aspect, the invention is a skateboard deck. The skateboard deck includes a substantially planar piece of a first material having a longitudinal axis and two opposed surfaces separated by a substantially uniform thickness. The piece has a first end portion and a second end portion located opposite one another along the axis. The substantially planar piece of the first material includes a plurality of longitudinal pieces of the first material, each of the longitudinal pieces having a longitudinal axis and a rectangular cross-section transverse to its longitudinal axis. Each of the rectangular cross-section longitudinal pieces has two opposed surfaces having a predetermined height. An adhesive is applied to at least some of the opposed surfaces of the rectangular cross-section longitudinal pieces, which are assembled so that at least one opposed surface of each of the rectangular cross-section longitudinal pieces is adjacent at least one opposed surface of another of the rectangular cross-section longitudinal pieces.

In accordance with another aspect, the invention includes an apparatus for making a skateboard deck. The apparatus includes means for forming a first substantially concave groove in a substantially planar piece of a first material having a longitudinal axis and two opposed surfaces separated by a substantially uniform thickness. The piece has a first end portion and a second end portion located opposite one another along the axis of the surfaces at the first end portion, the groove being substantially transverse to the axis and having a predetermined curvature at its deepest point. The apparatus also includes means for making a first frustocylindrical plug means for filling the first substantially concave groove. The plug means has a substantially planar surface and a substantially convex surface. The first frustocylindrical plug means has a curvature that is greater than the magnitude of the predetermined curvature of the groove. The convex surface of the first frustocylindrical plug means is placed in the groove so that the curvature of the first frustocylindrical plug means is greater than the magnitude of the curvature of the first frustocylindrical plug means at the point where the first frustocylindrical plug means meets the deepest point of the groove. The apparatus also includes means for permanently bending the first end portion toward the one surface.

According to an even further aspect, the invention is an apparatus for making a skateboard deck. The apparatus includes means for providing a substantially planar piece of a first material having a longitudinal axis and two opposed surfaces separated by a substantially uniform thickness. The piece has a first end portion and a second end portion located opposite one another along the axis. The apparatus further includes means for forming a thin protective piece from a piece of a second material, the protective piece being curved to substantially match the curvature of the first end portion of the piece of the first material. The apparatus still further includes means for coating the one side of the planar piece of the first material, the plug, and the protective piece of the second material with a coat of resin. The planar piece of the first material is coated near the first end portion. The apparatus also includes means for curing the outer coat of resin.

In accordance with a further aspect, the invention includes an apparatus for making skateboard deck. The apparatus includes means for providing a substantially planar piece of a first material having a longitudinal axis and two opposed surfaces separated by a substantially uniform thickness. The piece has a first end portion and a second end portion located opposite one another along the axis. The piece includes means for forming a plurality of longitudinal pieces of the first material. Each of the longitudinal pieces has a longitudinal axis and a rectangular cross-section transverse to its longitudinal axis. Each of the rectangular cross-section longitudinal pieces has two opposed surfaces having a predetermined height. The apparatus further includes means for applying an adhesive to at least some of the opposed surfaces of the rectangular cross-section longitudinal pieces and means for assembling the rectangular cross-section longitudinal pieces so that at least one opposed surface of each of the rectangular cross-section longitudinal pieces is adjacent at least one opposed surface of another of the rectangular cross-section longitudinal pieces. Still further, the apparatus includes means for curing the adhesive so that the plurality of longitudinal pieces of the first material forms the substantially planar piece of the first material, means for applying resin to the substantially planar piece of the first material, and means for curing the resin.

DETAILED DESCRIPTION OF THE PREFERRED EMBODIMENT OF THE INVENTION

Figure 1:
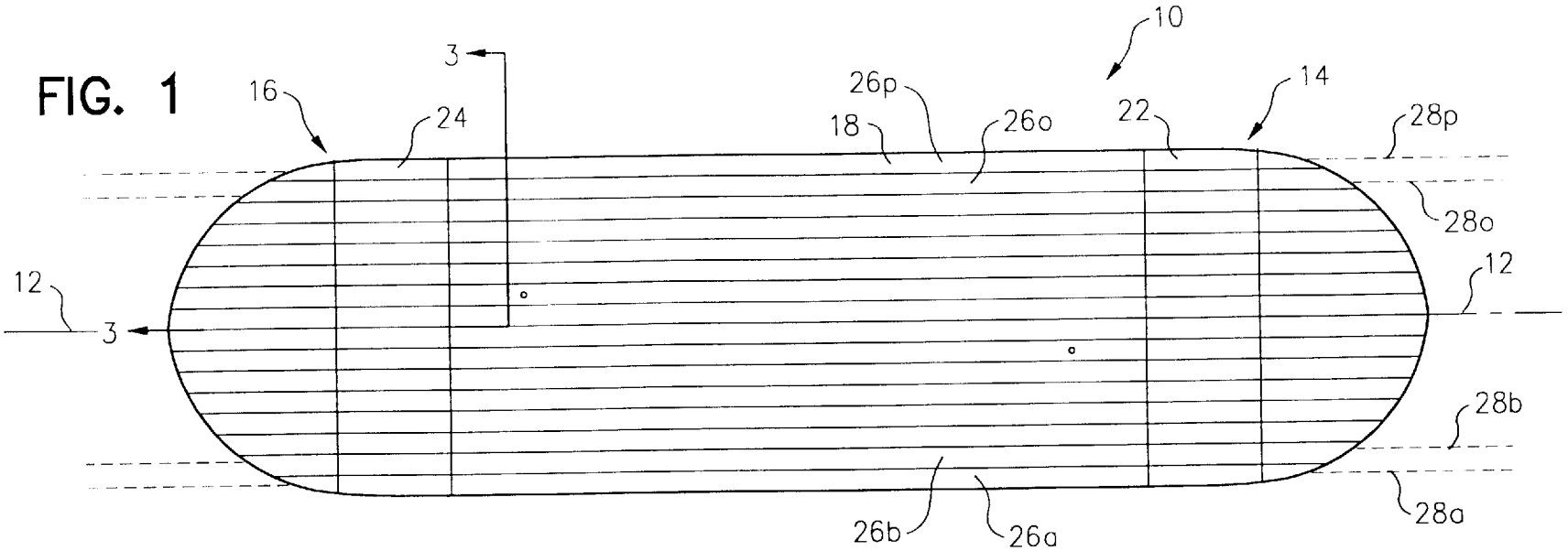
FIG. 1 is a plan view of the core of a skateboard deck, in accordance with the invention.
Figure 2:
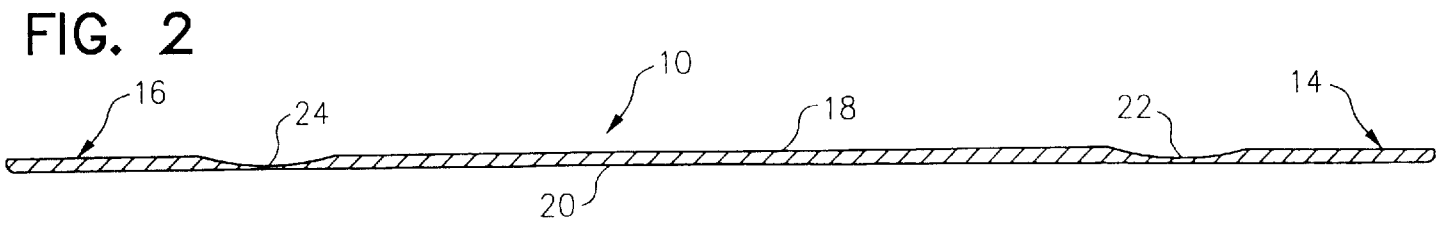
FIG. 2 is an elevation view of the core of the skateboard deck shown in FIG. 1, in accordance with the invention.

FIG. 1 is a plan view of the core of a skateboard deck, in accordance with the invention. FIG. 2 is an elevation view of the core of the skateboard deck shown in FIG. 1, in accordance with the invention. The core 10 is initially a substantially planar piece of a first material such as aspen or poplar wood. The core 10 has a longitudinal axis 12, a first end (tail) portion 14 and a second end (nose) portion 16. The core 10 has two major surfaces, an upper surface 18 and a lower surface 20 (not shown in FIG. 1). In the upper surface 18, at the first end portion 14, is formed a first substantially concave groove 22, and in the upper surface 18, at the second end portion 16, is formed a second substantially concave groove 24. The core 10 is naturally planar. If the core 10 is used to make a skateboard deck, the core 10 is approximately 8 inches wide, 32 inches long, and 0.4 inch thick in the center portion, down to approximately 0.3 inch at the end portions 14 and 16. The rounded ends of the respective first and second end portions 14 and 16 are semicircular, having a radius of approximately 4 inches.

If desired, the core 10 can be built without the second substantially concave groove 24.

Preferably, the core 10 is made from a plurality of pieces 12*a–p*. (Pieces 12*c–n* are not shown, for clarity.) Each of the pieces 26*a–p* is longitudinal and has a corresponding longitudinal axis 28*a–p*. (Longitudinal axes 12*c–n* are not shown, for clarity.) Each of the pieces 26*a–p* has a rectangular cross-section perpendicular to its corresponding longitudinal axis 28*a–p*. The rectangular cross-section of each of the pieces 26*a–p* generates planar surfaces. The planar surface generated by the upper edge of the cross-section of each of the pieces 26*a–p* forms a narrow strip that is a portion of the upper surface 18. The planar surface generated by the lower edge of the cross-section of each of the pieces 26*a–p* forms a narrow strip that is a portion of the lower surface 20. The planar surface generated by the upper edge of the cross-section opposes the planar surface generated by the lower edge of the cross-section of each of the pieces 26*a–p*. The remaining two edges (vertical edges) of the cross-section of each of the pieces 26*a–p* generate parallel vertical planar surfaces.

Adjoining pieces 26*a–p* (such as adjoining pieces 26*a* and 26*b* and adjoining pieces 26*o* and 26*p*) adjoin (and are adhered to) one another along the vertical surfaces generated by the vertical edges of the cross-section of each of the pieces 26*a–p*. A good adhesive for this application is a water-proof wood glue. As a result of this vertical lamination technique, the longitudinal axes 28*a–p* are parallel to one another and also to longitudinal axis 12. In a further preferred embodiment of the invention, the grain structure of the pieces 26*a–p* is substantially parallel to the longitudinal axes 28*a–p* and also to longitudinal axis 12. This results in superior fiber strength and minimal flex in the resulting core 10.

As will be understood by those skilled in the art, the scale of the core 10 can be changed so that the core described can be used in other similar applications, such as snowboards and water skis.

Figure 3:
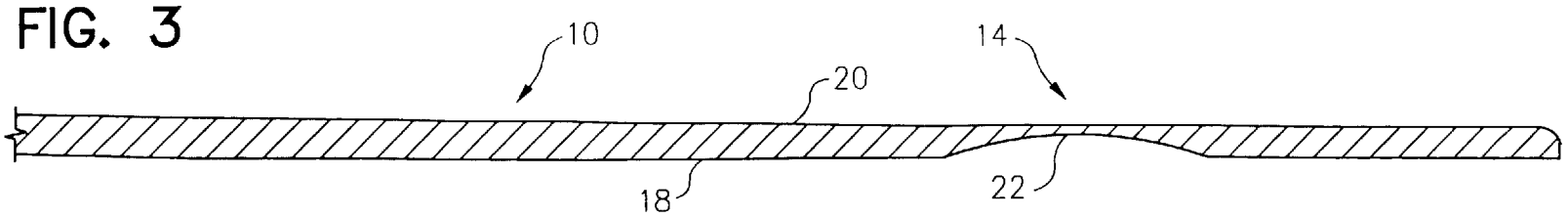
FIG. 3 is a close-up cross-sectional view of an end of the core of the skateboard deck shown in FIG. 1, in accordance with the invention.

FIG. 3 is a close-up cross-sectional view of an end of the core of the skateboard deck shown in FIG. 1, in accordance with the invention. The close-up cross-sectional view of Figure is inverted relative to the elevation view shown in FIG. 2. In this preferred embodiment, the core 10 can be seen to taper from 0.4 inch in thickness in the center portion (station 0) down to 0.3 inch at the end of the first end portion 14 (station 15). However, because of the slight taper of the first end portion 14, for the purposes of this disclosure, the upper and lower surfaces 18 and 22 of the core 10 are deemed to be substantially planar, and parallel to one another. The edge of the lower surface 20 is rounded, with a radius of approximately 0.25 inch. The groove 22 is cylindrical (the groove 24 is similar), having the approximate curvature of circular shell, and is transverse to the longitudinal axis 12. The groove 22 has a minimum thickness of less than approximately 0.090 inch and extends at least 3.25 inches parallel to the longitudinal axis 12.

Figure 4:
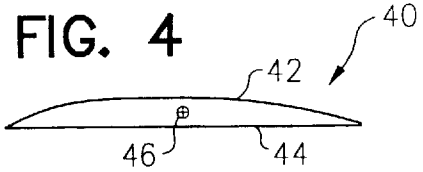
FIG. 4 is a close-up cross-sectional view of a filler piece of the core of the skateboard deck shown in FIG. 1, in accordance with the invention.

FIG. 4 is a close-up cross-sectional view of a filler piece of the core of the skateboard deck shown in FIG. 1, in accordance with the invention. The filler piece 40 has a convex surface 42 and a planar surface 44 and is in the form of a frustocylinder. Its maximum thickness is 0.22 inch from 1 inch to 1.5 inches (x-dimension) along the planar surface 44. Other thicknesses are shown in the following Table 1:

TABLE 1

| X | Y |
|---|---|
| 0.00 | 0.00 |
| 0.25 | 0.10 |
| 0.50 | 0.15 |
| 0.75 | 0.200 |

TABLE 1-continued

| X | Y |
|---|---|
| 1.00 | 0.220 |
| 1.25 | 0.220 |
| 1.50 | 0.220 |
| 1.75 | 0.200 |
| 2.00 | 0.200 |
| 2.25 | 0.175 |
| 2.50 | 0.125 |
| 2.75 | 0.075 |
| 3.00 | 0.050 |
| 3.25 | 0.00 |

The filler piece 40 has a longitudinal axis 46 that is perpendicular to the plane of FIG. 4. It is preferably made from the same material as the core 10, however, in general, it is a second material which may be the same as the first material. Also, preferably, the filler piece 40 is made from a plurality of parallel pieces of the second material that are parallel to the longitudinal axis 46 and glued together along planar surfaces similarly to the structure of the core 10. The curvature of the curved surface 42 of the filler pieces 40 is greater than the curvature of the grooves 22 and 24 in the core 10.

Figure 5:
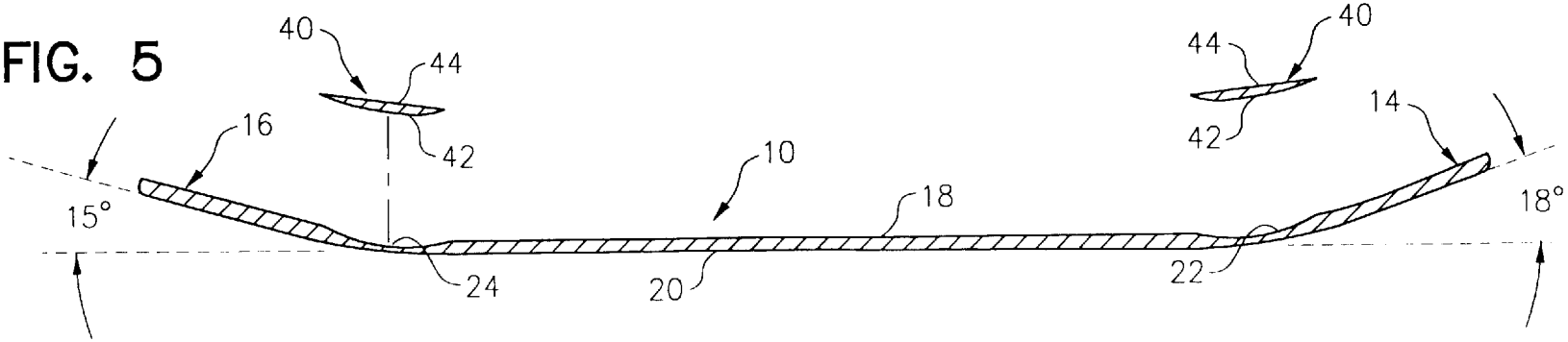
FIG. 5 is an exploded elevation view of the core of the skateboard deck shown in FIG. 1, in accordance with the invention.

FIG. 5 is an exploded elevation view of the core of the skateboard deck shown in FIG. 1, in accordance with the invention. As shown, copies of the filler piece 40 fit in the grooves 22 and 24. Since the curvature of the curved surface 42 of the filler pieces 40 is greater than the curvature of the grooves 22 and 24 in the core 10, the filler pieces 40 fit within the grooves 22 and 24 and touch the grooves 22 and 24 along the line where the grooves 22 and 24 are thinnest.

To assemble a skateboard deck from the core 10 and the filler pieces 40, the curved surfaces 42 and the grooves 22 and 24 are coated with a resin, such as an epoxy resin. The assembly can then be held in a fixed position until the epoxy resin cures, with the first and second ends 14 and 16 being bent upward, toward the upper surface 18. Preferably, however, a skateboard deck can be formed from the core 10 and the filler pieces 40 by fully coating the core 10, the filler pieces 40, and pieces of pregnable cloth such as fiberglass cloth or carbon fiber cloth, as will be understood by those skilled in the art.

In a particularly preferred embodiment, the skateboard deck can be formed by placing a sheet of pregnable cloth over the upper surface 18 and a sheet of pregnable cloth over the lower surface 20. These sheets of pregnable cloth are soaked in epoxy resin and have some threads that are parallel to the longitudinal axis 12 and other threads that are perpendicular to the first threads. A second sheet of pregnable cloth is placed on top of the sheet of pregnable cloth that has already been placed over the upper surface 18. The threads of this second sheet of pregnable cloth run at 45 degree angles to the threads in the sheet of pregnable cloth that has already been placed over the upper surface 18.

One form of epoxy resin that is useful in this process is ER-1, made by Applied Poleramic, Inc., of Benicia, Calif. The hardener for this epoxy resin is ER-3, also made by Applied Poleramic, Inc., of Benicia, Calif.

After the core 10 has been covered by the sheets of pregnable cloth, the covered core 10 is then placed in a tool that has been shaped in the desired manner. Typically, such a tool is made from aluminum and has two halves. The two halves are forced together in a heated press. The press is capable of producing pressures up to 1000 psi, but preferably approximately 100 psi, and temperatures up to 300 degrees Fahrenheit. Preferably the temperature is maintained between 168 and 170 degrees Fahrenheit. This pressure and temperature is maintained for 8 to 10 minutes. If desired, one or both of the outer sheets of pregnable cloth can replaced by a layer of PBT (which is an abrasion resistant plastic material made by Penn Fiber) or by a layer of a woven hemp material. Also, graphics can be applied to the outer surfaces of the skateboard deck in manners well-known to those skilled in the relevant arts.

Figure 6:
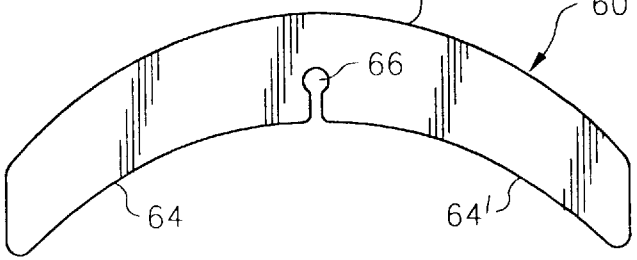
FIG. 6 is a plan view of a protective piece for use in a preferred embodiment of the skateboard deck, in accordance with the invention.

FIG. 6 is a plan view of a protective piece for use in a preferred embodiment of the skateboard deck, in accordance with the invention. The protective piece 60 is thin. It can either be made from sheet material such as sheet steel and processed to give it a textured surface that is clean of all oils and other epoxy-repellent materials or injection molded from a glass-filled urethane or nylon (such as Isoplast 101 or Nylon 6). This processing gives the protective piece 60 greater adherence as will be understood from the following discussion.

The protective piece 60 has a first outer curved edge 62 and a pair of inner curved edges 64 and 64'. The outer curved edge 62 has a radius of curvature that is approximately equal to the curvature of the first and second ends 14 and 16. The pair of inner curved edges 64 and 64' are substantially uniformly spaced from the first outer curved edge 62. Between the two edges 64 and 64' is a key-shaped cut-out 66 that opens into the curvature defined by the two edges 64 and 64'. Alternatively, the protective piece 60 can include a plurality of conventional apertures (not shown).

The protective piece 60 can be used to improve the durability of the edge of the lower surface 20. This is accomplished by molding the protective piece 60 to the skateboard deck along the curve of the edges of the lower surface 20 before the pregnable cloth is placed over the core 10. By this process, the key-shaped cut-out 66 of the protective piece 60 is filled with the epoxy resin before it begins to cure, so that the protective piece 60 is held in place against the core 10, even if the covering cloth is worn through or impacted. If, alternatively, the protective piece 60 includes a plurality of apertures (such as square or other standard geometric shapes), the apertures will be filled with the epoxy resin before it begins to cure, so that the protective piece 60 is held in place against the core 10. Although the protective piece 60 can be used at the first (tail) portion 14 of the core 10, it can also be used at the second (nose) portion 16 of the core 10, or at both end portions 14 and 16.

While the foregoing is a detailed description of the preferred embodiment of the invention, there are many alternative embodiments of the invention that would occur to those skilled in the art and which are within the scope of the present invention. Accordingly, the present invention is to be determined by the following claims.

I claim:

1. A skateboard deck, comprising:

a first piece of a first material having a longitudinal axis and first and second opposed surfaces separated by a substantially uniform thickness, the piece having a first end portion and a second end portion located opposite one another along the axis, the first piece of the first material having a first substantially concave groove formed in the first opposed surface at the first end portion, the groove being substantially transverse to the axis and having a predetermined curvature at its deepest point;

a first frustocylindrical plug of a second material having a substantially planar surface and a substantially convex surface, the plug having a curvature that is greater than the magnitude of the predetermined curvature of the groove, the convex surface of the plug being placed in the groove so that the curvature of the groove is greater than the magnitude of the curvature of the plug at the point where the plug meets the deepest point of the groove, the first end portion being bent toward the first opposed surface, wherein the first end portion is permanently bent upwardly toward the first opposed surface.

2. The skateboard deck of claim 1, further comprising:

a second substantially concave groove in the one surface at the second end portion, the second groove being substantially transverse to the axis and having a predetermined curvature at its deepest point;

a second frustocylindrical plug of the second material having a substantially planar surface and a substantially convex surface, the second plug having a curvature that is greater than the magnitude of the predetermined curvature of the second groove, the convex surface of the second plug being placed in the second groove so that the curvature of the second plug is greater than the magnitude of the curvature of the second plug at the point where the second plug meets the deepest point of the second groove;

the second end portion being bent toward the one surface, whereby the second end portion is permanently bent upwardly toward the one surface.

3. The skateboard deck of claim 1, further comprising:

a thin protective piece from a piece of a third material, the protective piece being curved to substantially match the curvature of the first end portion of the piece of the first material and being placed against the second opposed surface in one of the two end portions, the first end portion having a curved edge, and the protective piece being substantially conformal to the curved edge of the one of the two end portions.

4. The skateboard deck of claim 3, wherein the protective piece has two substantially uniformly spaced curved edges, at least one of the two curved edges having formed therein a cut-out region.

5. The skateboard of claim 1, wherein the first piece of the first material includes a plurality of longitudinal pieces of the first material, each of the longitudinal pieces having a longitudinal axis and a rectangular cross-section transverse to its longitudinal axis, each of the rectangular cross-section longitudinal pieces having two opposed surfaces having a predetermined height, the rectangular cross-section longitudinal pieces being assembled so that at least one opposed surface of each of the rectangular cross-section longitudinal pieces is fastened to at least one opposed surface of another of the rectangular cross-section longitudinal pieces.

6. The skateboard deck of claim 5, wherein each of the plurality of longitudinal pieces of the first material has grains that are substantially parallel to the longitudinal axes of each of the plurality of longitudinal pieces of the first material.

7. The skateboard deck of claim 6, further including a sheet of pregnable fiber material over the one of the two surfaces and over the planar surface of the plug, the sheet of pregnable fiber material being impregnated by a resin, the resin then being cured.

* * * * *